US011248394B2

(12) United States Patent
Cai

(10) Patent No.: US 11,248,394 B2
(45) Date of Patent: Feb. 15, 2022

(54) LAMINATED PADLOCK

(71) Applicant: NINGBO JIANGBEI RUIFENG LOCK INDUSTRY CO., LTD., Ningbo (CN)

(72) Inventor: Zhihui Cai, Ningbo (CN)

( * ) Notice: Subject to any disclaimer, the term of this patent is extended or adjusted under 35 U.S.C. 154(b) by 90 days.

(21) Appl. No.: 16/880,611

(22) Filed: May 21, 2020

(65) Prior Publication Data

US 2021/0301556 A1 Sep. 30, 2021

(30) Foreign Application Priority Data

Mar. 26, 2020 (CN) ..... 202020402707.6

(51) Int. Cl.
*E05B 37/02* (2006.01)
*E05B 67/02* (2006.01)
*E05B 67/22* (2006.01)

(52) U.S. Cl.
CPC ..... *E05B 37/025* (2013.01); *E05B 67/02* (2013.01); *E05B 67/22* (2013.01)

(58) Field of Classification Search
CPC ..... E05B 37/02; E05B 37/025; E05B 67/02; E05B 67/22
See application file for complete search history.

(56) References Cited

U.S. PATENT DOCUMENTS 1,718,606 A * 6/1929 Soref ..... E05B 67/22 70/38 C
2,352,190 A * 6/1944 Foote ..... E05B 67/22 29/437
2,893,232 A * 7/1959 Foote ..... E05B 67/22 70/38 B
3,419,893 A * 12/1968 Vahlstrom ..... E05B 37/025 70/24
3,548,486 A * 12/1970 Foote ..... E05B 67/02 29/469
3,817,063 A * 6/1974 Williams ..... E05B 37/025 70/24
4,899,560 A * 2/1990 Chen ..... E05B 67/02 70/52

(Continued)

FOREIGN PATENT DOCUMENTS

KR 20120042317 A * 5/2012

*Primary Examiner* — Christopher J Boswell
(74) *Attorney, Agent, or Firm* — Prakash Nama; Global IP Services, PLLC

(57) ABSTRACT

A laminated padlock comprises a laminated padlock body formed by laminating a plurality of lock sheets, a lock core assembly, and a lock beam connected with the top of the laminated padlock body. The lock core assembly comprises a first lock tongue, a second lock tongue, a large frame, a small frame, a lock core shaft and cipher wheels; the large frame is provided with a positioning resilient piece, and the lower end of the large frame is provided with a limiting plate with a limiting chuck; shaft holes; the small frame is provided with a small resilient piece, and a branch plate is arranged below. The laminated padlock achieves dual guarantee, perfectly solves the defect that the ciphers can be changed by a cipher adjusting rod under the condition of not knowing the ciphers when the lock beam is opened and greatly enhances the safety performance of the laminated padlock.

10 Claims, 14 Drawing Sheets

(56) References Cited

U.S. PATENT DOCUMENTS

| | | | | |
|---|---|---|---|---|
| 6,012,309 | A * | 1/2000 | Liu | E05B 37/025 70/25 |
| 7,536,883 | B1 * | 5/2009 | Liu | E05B 37/025 70/25 |
| 8,539,799 | B2 * | 9/2013 | Nave | E05B 37/025 70/21 |
| 10,221,592 | B2 * | 3/2019 | Rodaer | E05B 67/24 |
| 2021/0062542 | A1 * | 3/2021 | Lai | E05B 37/025 |

* cited by examiner

LAMINATED PADLOCK

TECHNICAL FIELD

The present invention relates to the technical field of locks, and particularly to a laminated padlock.

BACKGROUND

The laminated padlock is a lock body formed by a laminated steel sheet structure and having strong anti-strike capability, and is generally composed of the lock body, a lock beam and a lock core assembly. The structure of a laminated padlock with cipher wheel adopted in the prior art does not limit the position of the cipher wheel, so that a cipher adjusting rod for adjusting cipher can be inserted under the condition that the cipher is not accurate when the cipher of the laminated padlock is adjusted, thereby greatly reducing the safety performance of the laminated padlock. In addition, by arranging a simple structure that limits the cipher wheel, part of laminated padlocks, e.g., a laminated padlock disclosed by the utility model with application number of 201922221485.8, cannot completely guarantee the safety performance of the laminated padlocks. Therefore, a laminated padlock which can guarantee the cipher adjusting safety of the laminated padlock is urgently needed.

SUMMARY

A technical problem to be solved by the utility model is to provide a laminated padlock with a more reasonable structure aiming at the problems of the prior art.

A technical solution adopted to solve the above technical problems in the utility model is as follows:

A laminated padlock comprises a laminated padlock body formed by laminating a plurality of lock sheets and riveting with rivets, a lock core assembly arranged in the laminated padlock body, and a lock beam connected with the top of the laminated padlock body; one end of the lock beam connected with the laminated padlock body is provided with a lock beam spring; the lock beam expands and contracts up and down to open and close the laminated padlock; the middle of the lock sheet is provided with an adaptive installation port; when a plurality of lock sheets are laminated together, the installation port forms an accommodating cavity in the laminated padlock body; the lock core assembly is installed in the accommodating cavity, and a plurality of rivet holes are also arranged on the lock sheets; the rivets are matched with the rivet holes to rivet and fix the plurality of lock sheets into a whole; the lock core assembly comprises a first lock tongue and a second lock tongue which are mutually matched, a large frame, a small frame, a lock core shaft and cipher wheels; the first lock tongue and the second lock tongue are connected through a lock tongue pin; the lock tongue pin is provided with a lock tongue spring for returning the first lock tongue and the second lock tongue; the large frame and the small frame are docked below the first lock tongue and the second lock tongue; the middle of the large frame is provided with a first opening; a positioning resilient piece is inserted into the first opening; both sides of the large frame are symmetrically provided with shaft holes; the lock core shaft is installed on the large frame through the shaft holes; the middle of the small frame is provided with a second opening; a small resilient piece is inserted into the second opening, and the lower part of the small frame is provided with a bending part and a plurality of branch plates; the lock core shaft is sleeved with a plurality of short lock cores and long lock cores; one end of the short lock cores and the long lock cores is respectively provided with a circular arc part; the circular arc parts are provided with rectangular notches; the other end of the short lock cores and the long lock cores is respectively provided with bulges; one end of the lock core shaft which extends from the large frame is provided with a nut; a lock core spring is installed between the nut and the side edge of the large frame; the lock core shaft on the inner side of the lock core spring is provided with a copper sheath; and the lock core shaft on the inner side of the large frame is provided with a plurality of cipher wheels.

Preferably, the lower part of the large frame is provided with a plurality of bar-shaped limiting plates; the bar-shaped limiting plates are distributed among the cipher wheels; and the ends of the bar-shaped limiting plates are provided with L-shaped limiting chucks adapted with the rectangular notches.

Preferably, the upper part of the small frame is provided with an end part bent towards the large frame; the end part can rotate back and forth between the first lock tongue and the second lock tongue, thereby controlling the opening and closing of the laminated padlock; the bending part is clamped to the outer side of the lock core shaft; and the branch plates are distributed among the cipher wheels.

Preferably, the first lock tongue and the second lock tongue are rectangles with a V-shaped head at one end, and the V-shaped heads are arranged opposite to each other; and both sides of the lock beam corresponding to the V-shaped heads of the first lock tongue and the second lock tongue are provided with adaptive positioning grooves.

Preferably, one end of the lock beam provided with the lock beam spring is provided with a lock beam card and a lock beam card gasket.

Preferably, one end of the small resilient piece is bent and abutted against the small frame, and the other end is abutted against the inner side wall of the laminated padlock body; a clamping part is arranged above the positioning resilient piece, and a plurality of dialing plates are arranged below the positioning resilient piece; and the dialing plates are abutted against the grooves of the cipher wheels.

Preferably, engaging parts are arranged in the centers of the cipher wheels; and the engaging parts are matched and connected with the bulges on the short lock cores and the long lock cores.

Preferably, the upper lock sheet and the lower lock sheet in the plurality of lock sheets near the first lock tongue and the second lock tongue are provided with lock holes; the lock holes can be used for locking the lock beam to the laminated padlock body; when the cipher is adjusted, a cipher adjusting rod needs to be used together; and one end of the cipher adjusting rod inserted into the lock holes is provided with an inserting joint.

Preferably, a flat end surface is cut on the circular arc part; and when the flat end surface rotates tangent to the branch plate, the branch plate rotates inwards to drive the end part of the small frame away from the lock tongue pin.

Preferably, when the cipher wheel is adjusted to a state of right cipher, the flat end surface is tangent to the branch plate; the limiting chucks are docked with the notches; after the cipher adjusting rod is inserted from the lock holes and pushed to rotate, the lock core shaft moves to the other side, so that the bulges of the short lock cores and the long lock cores are separated from the engaging parts on the cipher wheels; and at this moment, new ciphers can be changed.

Compared with the prior art, the laminated padlock of the utility model has the beneficial effects: by arranging the rectangular notches and the flat end surfaces on the long lock cores and the short lock cores sleeved on the lock core shaft, the positions of the lock cores are limited under the cooperation of the large frame and the small frame, thereby adjusting the relative positions of the bulges on the lock cores and the engaging parts on the cipher wheels. When the ciphers are reset, the positions of the cipher wheels are limited. When the ciphers are incorrect, the cipher adjusting rod cannot rotate and cannot push the lock core shaft to move, i.e., cannot reset the ciphers, thereby realizing dual guarantee, perfectly solving the defect that the ciphers can be changed by the cipher adjusting rod under the condition of not knowing the ciphers when the lock beam is opened, and greatly enhancing the safety performance of the laminated padlock.

Reference Signs: 1 lock sheet; 11 rivet hole; 12 lock hole; 2 lock beam; 21 positioning groove; 22 lock beam spring; 23 lock beam card; 24 lock beam card gasket; 3 rivet; 4 cipher adjusting rod; 41 inserting joint; 5 first lock tongue; 51 lock tongue pin; 52 lock tongue spring; 6 second lock tongue; 61 V-shaped head; 7 large frame; 71 first opening; 72 positioning resilient piece; 721 clamping part; 722 dialing plate; 73 shaft hole; 74 limiting plate; 741 limiting chuck; 8 small frame; 81 end part; 82 bending part; 83 branch plate; 84 second opening; 85 small resilient piece; 9 lock core shaft; 91 short lock core; 911 bulge; 912 notch; 92 long lock core; 921 circular arc part; 9211 flat end surface; 93 copper sheath; 94 nut; 95 lock core spring; 96 cipher wheel; 961 engaging part.

DETAILED DESCRIPTION

The utility model is further described below in detail in combination with the drawings and embodiments.

Figure 1:
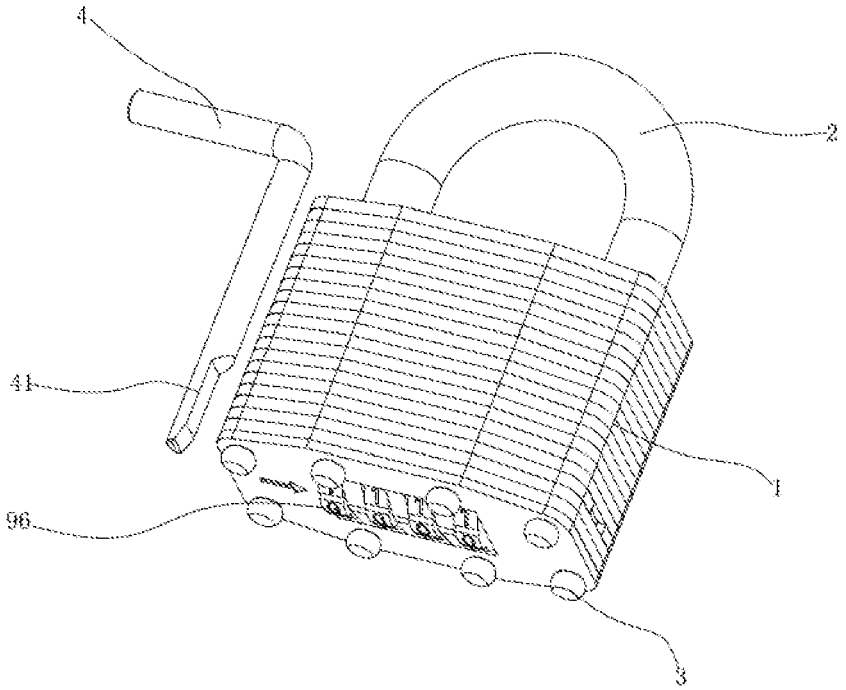
FIG. 1 is a stereographic structural diagram of a laminated padlock of the utility model.
Figure 2:
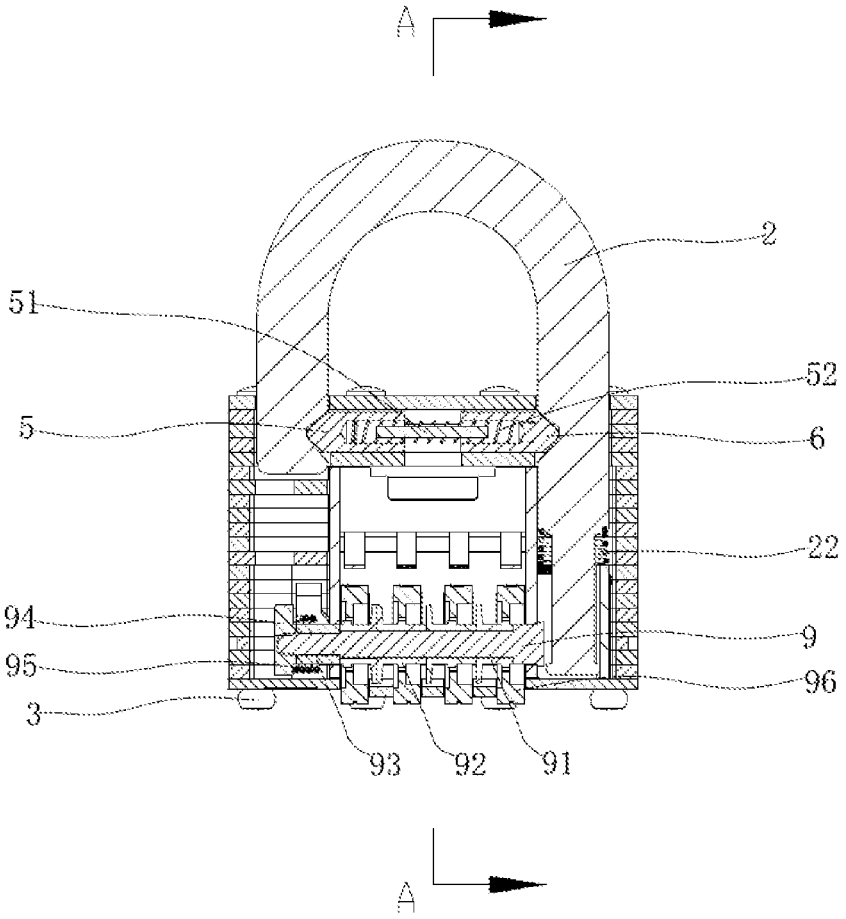
FIG. 2 is a main view of a laminated padlock of the utility model.
Figure 3:
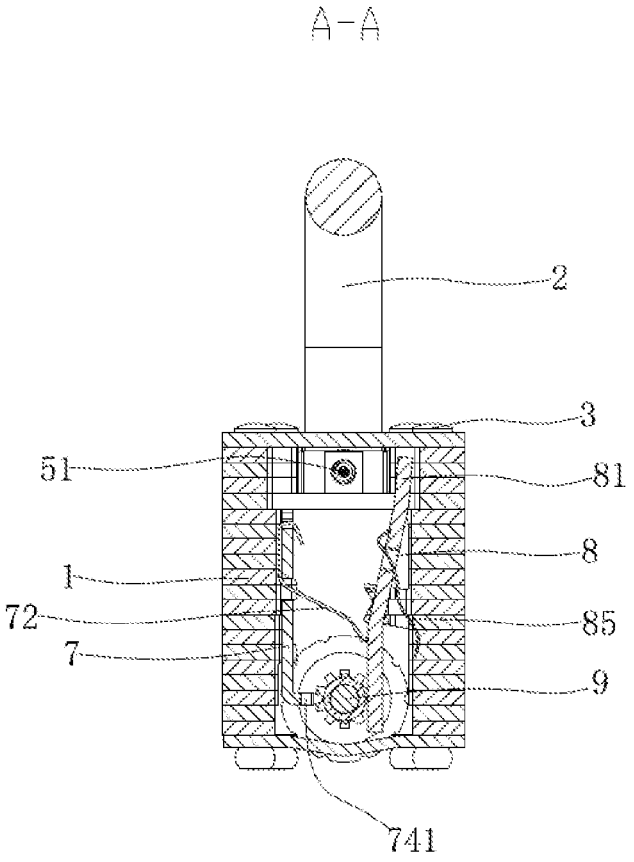
FIG. 3 is an A-A sectional view of FIG. 2 of a laminated padlock of the utility model.
Figure 4:
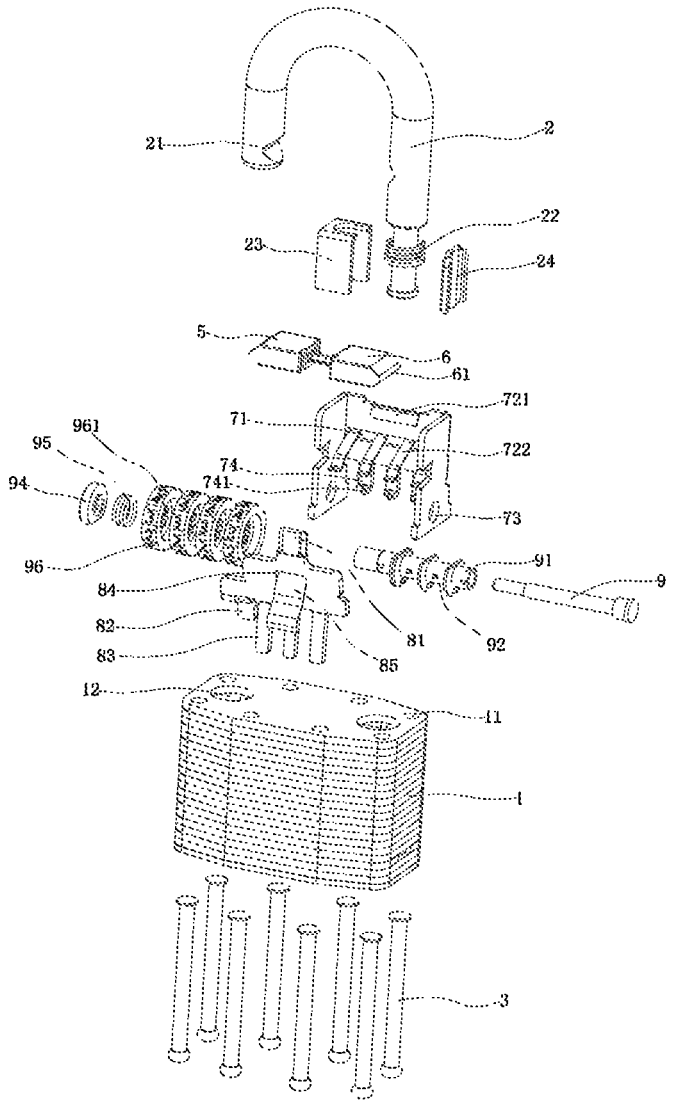
FIG. 4 is a structural exploded schematic diagram of a laminated padlock of the utility model.
Figure 5:
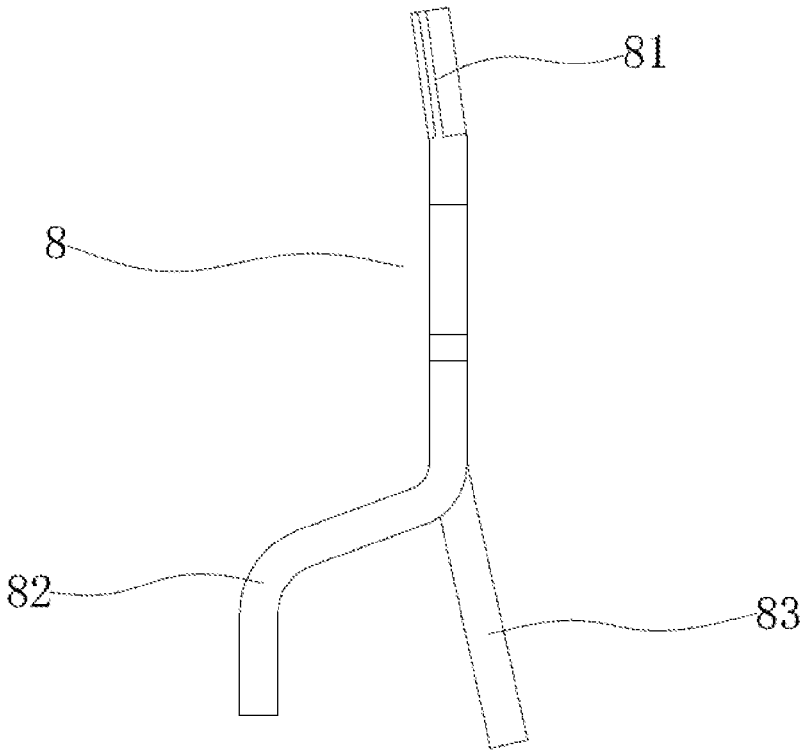
FIG. 5 is a structural schematic diagram of a small frame in a stereographic schematic diagram of a laminated padlock of the utility model.
Figure 6:
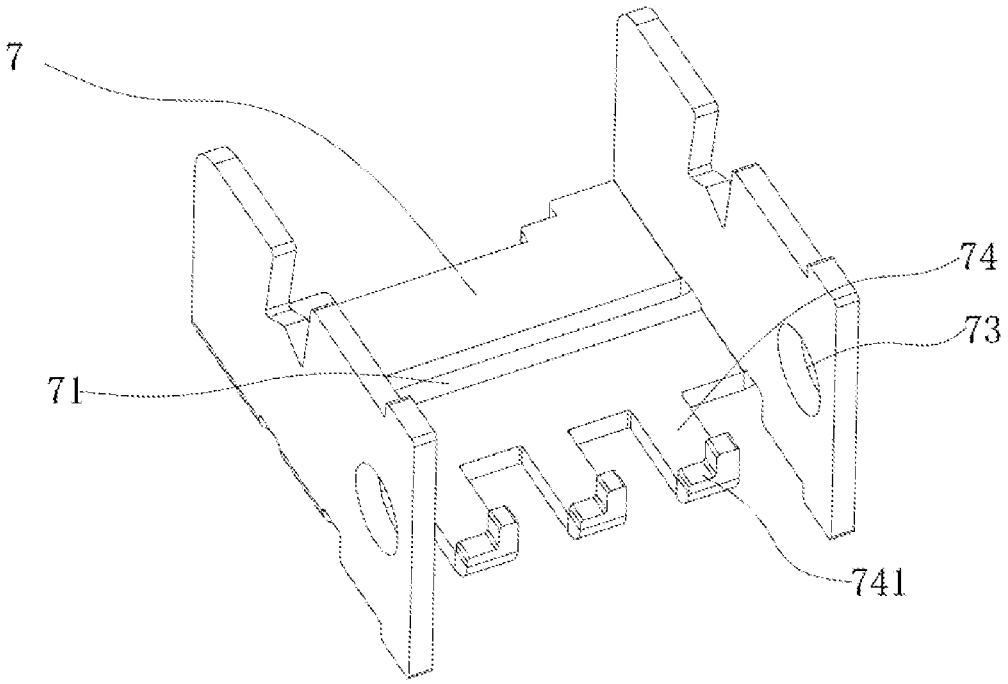
FIG. 6 is a structural schematic diagram of a large frame in a stereographic schematic diagram of a laminated padlock of the utility model.
Figure 7:
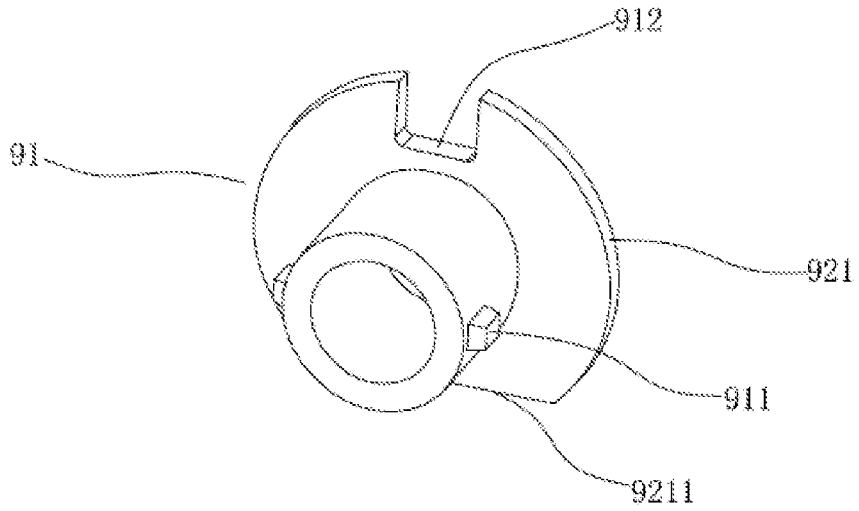
FIG. 7 is a structural schematic diagram of a short lock core in a stereographic schematic diagram of a laminated padlock of the utility model.
Figure 8:
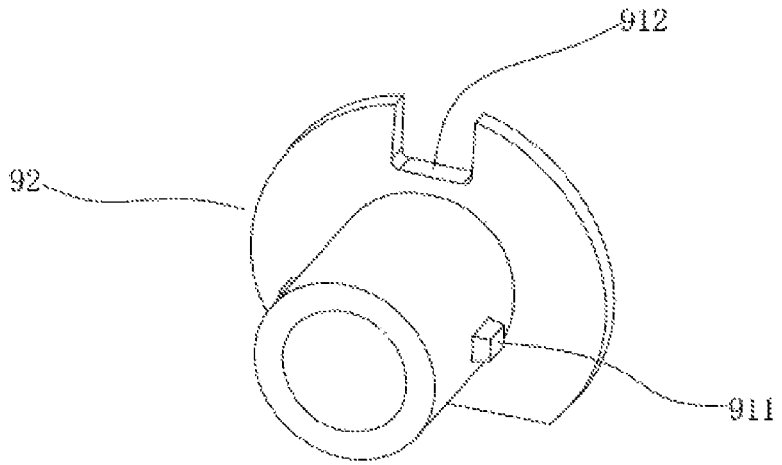
FIG. 8 is a structural schematic diagram of a long lock core in a stereographic schematic diagram of a laminated padlock of the utility model.
Figure 9:
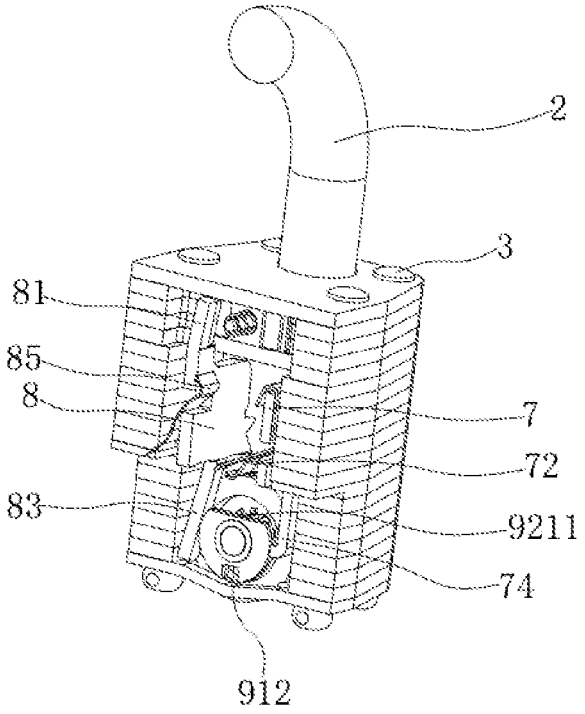
FIG. 9 is an internal sectional view of a laminated padlock of the utility model (locked state).
Figure 10:
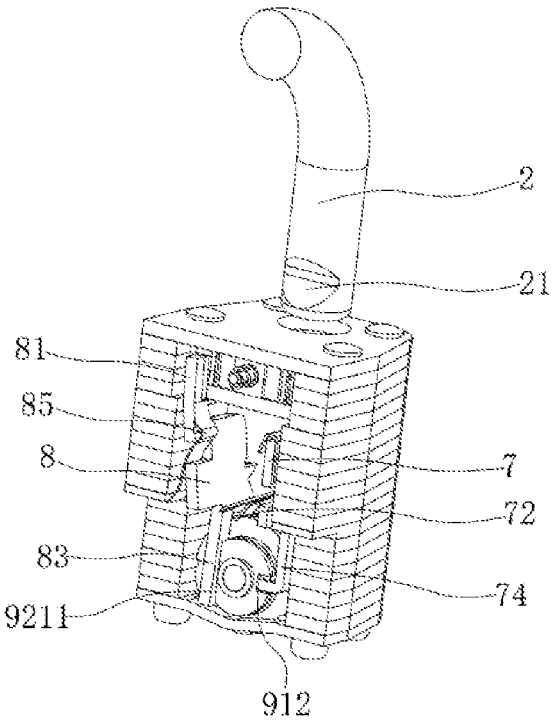
FIG. 10 is an internal sectional view of a laminated padlock of the utility model (unlocked state).

As shown in FIG. 1 to FIG. 10, a laminated padlock in the present embodiment comprises a laminated padlock body formed by laminating a plurality of lock sheets 1 and riveting with rivets 3, a lock core assembly arranged in the laminated padlock body, and a lock beam 2 connected with the top of the laminated padlock body; one end of the lock beam 2 connected with the laminated padlock body is provided with a lock beam spring 22; and the lower end of the lock beam spring 22 is provided with a lock beam card 23 and a lock beam card gasket 24 for fixing the lock beam 2.

In the present embodiment, the lock sheets 1 are selected from steel sheets; the middles of the lock sheets are provided with adaptive installation ports; when a plurality of lock sheets 1 are laminated together, each installation port forms an accommodating cavity in the laminated padlock body, and the shapes of the installation ports are adapted with the built-in lock core assembly; and the lock core assembly can be fixedly installed in the laminated padlock body. The installation port of the lowest lock sheet 1 of the laminated padlock body is exposed from the cipher wheel 96, so that the user can dial the cipher wheel 96. Eight rivet holes 11 are uniformly distributed on the edges of the lock sheets 1, and the rivets 3 penetrate through the rivet holes 11 to rivet and fix the lock sheets 1 into a whole. Meanwhile, the upper and lower lock sheets 1 in the plurality of lock sheets 1 near the first lock tongue 5 and the second lock tongue 6 are provided with lock holes 12; and the lock holes 12 can be used for locking the lock beam 2 to the laminated padlock body.

The lock core assembly comprises a first lock tongue 5 and a second lock tongue 6 which are mutually matched, a large frame 7, a small frame 8, a lock core shaft 9 and cipher wheels 96. The first lock tongue 5 and the second lock tongue 6 are connected through a lock tongue pin 51; the lock tongue pin 51 is provided with a lock tongue spring 52 for returning the first lock tongue 5 and the second lock tongue 6; and the large frame 7 and the small frame 8 are docked and installed below the first lock tongue 5 and the second lock tongue 6. Specifically, the first lock tongue 5 and the second lock tongue 6 are rectangles with a V-shaped head 61 at one end; and the ends of the first lock tongue 5 and the second lock tongue 6 having the V-shaped heads 61 are arranged opposite to each other, and the other ends are provided with lock tongue grooves. Both sides of the lock beam 2 corresponding to the V-shaped heads 61 of the first lock tongue 5 and the second lock tongue 6 are provided with adaptive positioning grooves 21.

A long first opening 71 is arranged in the middle of the large frame 7, and a positioning resilient piece 72 is inserted in the first opening 71. After the positioning resilient piece 72 is inserted into the first opening 71, the upper part of the positioning resilient piece is bent downwards to form a clamping part 721, and the clamping part 721 is fixed on the large frame 7. Four bar-shaped dial plates 722 are arranged at the lower end of the positioning resilient piece 72, and the dial plates 722 are abutted against the grooves of the cipher wheels 96, to prevent the cipher wheels 96 from rotating randomly and avoid causing that the correct ciphers cannot be aligned with the bottom scale line. The lower part of the large frame 7 is provided with three bar-shaped limiting plates 74; the bar-shaped limiting plates 74 are distributed among the cipher wheels 96; and the ends of the bar-shaped limiting plates 74 are provided with L-shaped limiting chucks 741 adapted with the rectangular notches 912.

In addition, both sides of the large frame 7 are symmetrically provided with shaft holes 73; and the lock core shaft 9 is installed on the large frame 7 through the shaft holes 73.

The lock core shaft 9 on the inner side of the large frame 7 is provided with a plurality of cipher wheels 96, and engaging parts 961 are arranged in the centers of the cipher wheels 96. The upper part of the small frame 8 is provided with an end part 81 bent towards the large frame 7; and the end part 81 can rotate back and forth between the first lock tongue 5 and the second lock tongue 6, to adjust the distance between the first lock tongue 5 and the second lock tongue 6, thereby controlling the opening and closing of the laminated padlock.

The middle of the small frame 8 is provided with a rectangular second opening 84; a small resilient piece 85 is inserted into the second opening 84 from inside to outside; one end of the small resilient piece 85 is bent and abutted against the small frame 8, and the other end is abutted against the inner side wall of the laminated padlock body to provide a supporting point for the rotation of the small frame 8. The lower part is provided with a bending part 82 and three branch plates 83, wherein the bending part 82 is clamped to the outer side of the lock core shaft 9; and the branch plates 83 are distributed among the cipher wheels 96.

The lock core shaft 9 is sleeved with two short lock cores 91 and two long lock cores 92; one end of the short lock cores 91 and the long lock cores 92 is respectively provided with a circular arc part 921; the circular arc parts 921 are provided with rectangular notches 912 in the middle of one side; a flat end surface 9211 is cut on the other side; and when the flat end surface 9211 rotates tangent to the branch plate 83, the branch plate 83 rotates inwards to drive the end part 81 of the small frame 8 away from the lock tongue pin 51. In the present embodiment, the short lock cores 91 are arranged on both ends of the lock core shaft 9, and the long lock cores 92 are arranged in the middle of the lock core shaft 9.

Specifically, the circular arc parts 921 of the sleeved short lock cores 91 and long lock cores 92 are connected, and symmetrical bulges 911 are arranged on the short lock cores 91 and the long lock cores 92; and the engaging parts 961 of the cipher wheels 96 are matched with the bulges 911 on the short lock cores 91 and the long lock cores 92 to rotate. One end of the lock core shaft 9 that extends from the large frame 7 is provided with a nut 94; a lock core spring 95 for returning is installed between the nut 94 and the side edge of the large frame 7; and the lock core shaft 9 on the inner side of the lock core spring 95 is provided with a copper sheath 93.

The unlocking principle of the laminated padlock: when four cipher wheels 96 corresponding to the bottom scale lines are correct, the flat end surfaces 9211 of the circular arc parts 921 of the short lock cores 91 and the long lock cores 92 are tangent to the branch plates 83 of the small frame 8. At this moment, the end part 81 of the small frame 8 is separated from the lock tongue groove; the lock beam 2 moves upwards under the action of the lock beam spring 22; the first lock tongue 5 and the second lock tongue 6 move toward the middle; the lock tongue spring 52 is compressed; and the V-shaped heads 61 of the first lock tongue 5 and the second lock tongue 6 are separated from the positioning groove 21 of the lock beam 2 to realize unlocking.

The locking principle: when any one of four cipher wheels 96 corresponding to the bottom scale lines is incorrect, the branch plates 83 of the small frame 8 are tangent to the circular arc parts 921 of the short lock cores 91 and the long lock cores 92. At this moment, the end part 81 of the small frame 8 is clamped in the lock tongue groove; the first lock tongue 5 and the second lock tongue 6 cannot move toward the middle; the V-shaped heads 61 of the first lock tongue 5 and the second lock tongue 6 are clamped in the positioning grooves 21 of the lock beam 2; and the lock beam 2 cannot move upwards to realize locking.

The cipher adjusting process of the laminated padlock in the present embodiment is as follows: the cipher wheels 96 are dialed so that correct ciphers are aligned with the bottom scale lines of the laminated padlock; the lock beam 2 is pressed down with force so that the lock beam 2 automatically bounces; then, the cipher adjusting rod 4 is taken out, vertically inserted into the lock hole 12 and pressed to the bottom with force; the cipher adjusting rod 4 is inserted to the bottom and then rotated by 180 degrees; reset ciphers are aligned with the bottom scale lines; and at this moment, the ciphers are changed successfully and new ciphers shall be well remembered. After the ciphers are changed, the cipher adjusting rod is rotated back by 180 degrees; the cipher adjusting rod 4 is pulled out; the ciphers are randomly dialed; and the lock beam 2 is pressed down to realize a locking state.

Figure 11:
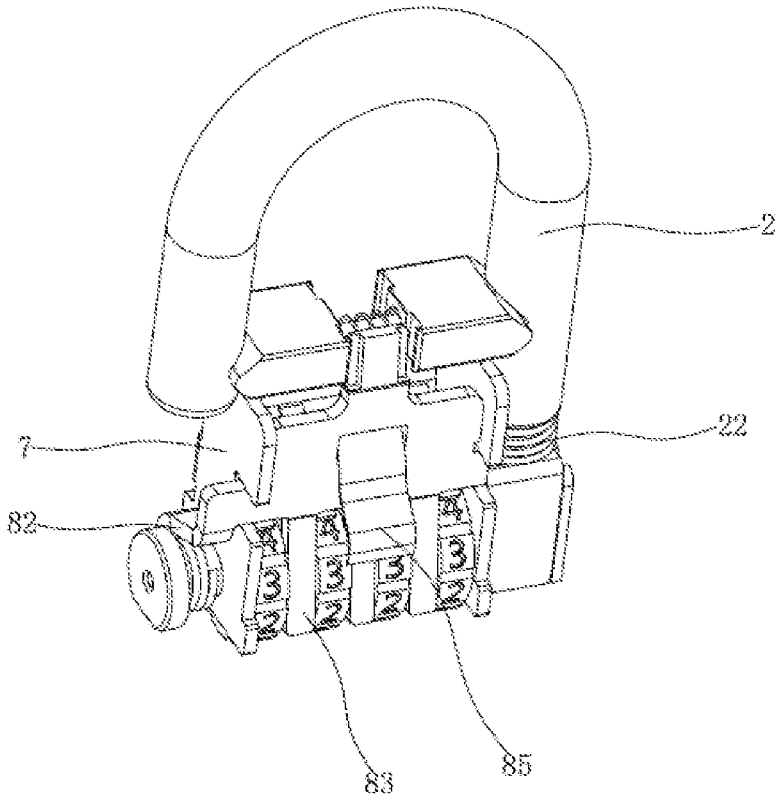
FIG. 11 is a structural schematic diagram of a laminated padlock without an external lock sheet in the utility model.
Figure 12:
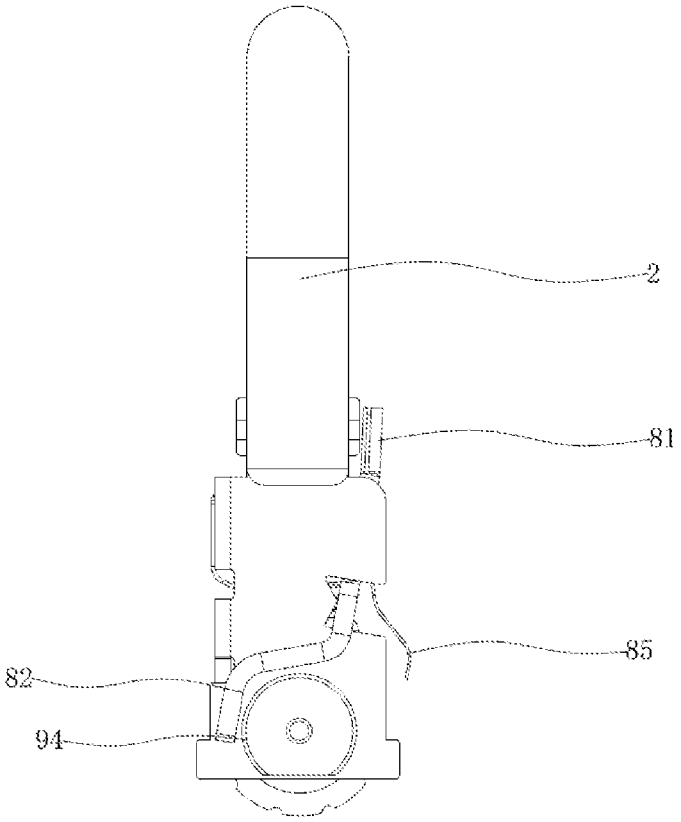
FIG. 12 is a side view of FIG. 11 of a laminated padlock of the utility model (unlocked state).
Figure 13:
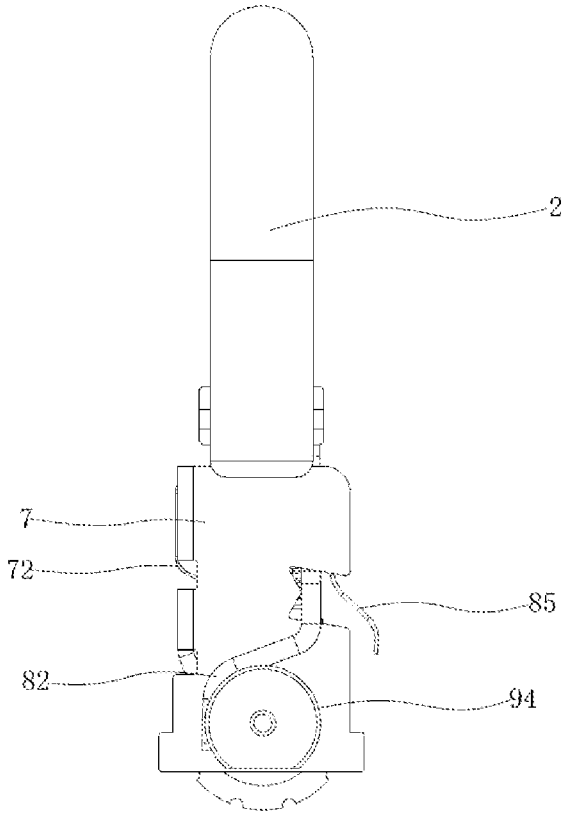
FIG. 13 is a side view of FIG. 11 of a laminated padlock of the utility model (locked state).
Figure 14:
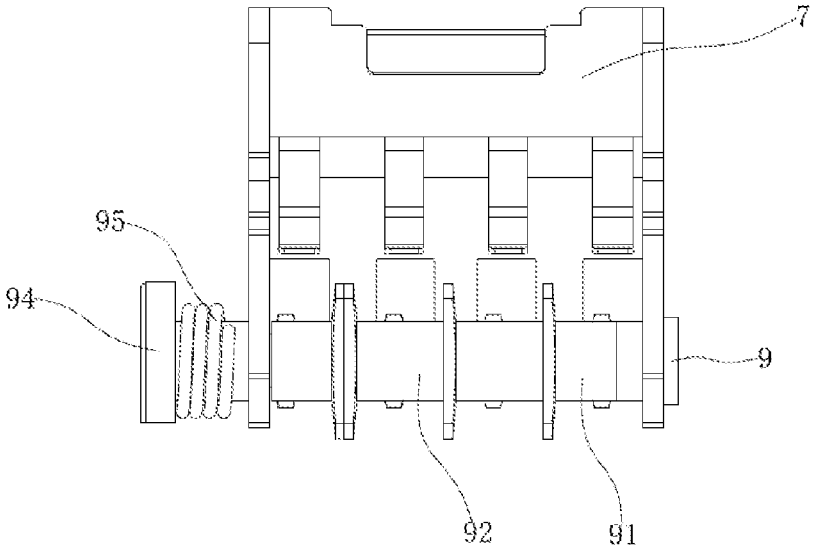
FIG. 14 is a schematic diagram of lock core matching of a laminated padlock of the utility model.

As shown in FIG. 11-FIG. 14, the cipher adjusting principle: when the cipher wheel 96 is adjusted to a state of right cipher, the flat end surface 9211 is tangent to the branch plate 83; the limiting chucks 741 are docked with the notches 912; the cipher adjusting rod 4 is inserted from the lock holes 12 and abutted against the nut 94; at this moment, the bending part 82 of the small frame is separated from the nut 94; the cipher adjusting rod 4 is abutted against the nut 94 so that the lock core shaft 9 drives other components to move to the other side and the bulges 911 of the short lock cores 91 and the long lock cores 92 are separated from the engaging parts 961 on the cipher wheels; and at this moment, new ciphers can be changed.

When the ciphers are not completely correct, i.e., when any one cipher is wrong, the bending part 82 of the small frame is in the nut 94; and at this moment, the cipher adjusting rod 4 cannot push the nut 94 and the lock core shaft 9 cannot move. Meanwhile, at least one of the flat end surfaces 9211 of the long lock cores 92 and the short lock cores 91 is not in the same plane, i.e., the notch 912 of at least one lock core and the limiting chuck 741 on the large frame 7 are partially misaligned; if the cipher adjusting rod 4 is inserted at this moment, at least one flat end surface 9211 is partially blocked by the limiting chuck 741 so that the bulge 911 on the lock core cannot be separated from the engaging part 961 on the cipher wheel 96. At this moment, the ciphers cannot be changed successfully.

In addition, when the ciphers are not completely correct, the bending part 82 of the small frame 8 may clamp the nut 94 on one end of the lock core shaft 9 so that the lock core shaft 9 cannot move and the bulge 911 on the lock core cannot be separated from the engaging part 961 on the cipher wheel 96. Similarly, the ciphers cannot be changed. Thus, dual guarantee is realized, and the defect that the ciphers can be changed by the cipher adjusting rod 4 under the condition of not knowing the ciphers when the lock beam 2 is opened can be perfectly solved.

The utility model provides a laminated padlock. By arranging the rectangular notches and the flat end surfaces on the long lock cores and the short lock cores sleeved on the lock core shaft, the positions of the lock cores are limited under the cooperation of the large frame and the small frame, thereby adjusting the relative positions of the bulges on the lock cores and the engaging parts on the cipher wheels. When the ciphers are reset, the positions of the cipher wheels are limited. When the ciphers are incorrect, the cipher adjusting rod cannot rotate and cannot push the lock core shaft to move, i.e., cannot reset the ciphers. Compared with the prior art, the laminated padlock realizes the dual guarantee, perfectly solves the defect that the ciphers can be changed by the cipher adjusting rod under the condition of not knowing the ciphers when the lock beam is opened and greatly enhances the safety performance of the laminated padlock.

Finally, it should be noted that the above embodiments are only used for describing the technical solution of the utility model rather than limitation. Although the utility model is described in detail by referring to the above embodiments, those ordinary skilled in the art should understand that: the technical solution recorded in each of the above embodiments can be still amended, or some technical features therein can be replaced equivalently. However, these amendments or replacements do not enable the essence of the corresponding technical solution to depart from the spirit and the scope of the technical solution of various embodiments of the utility model.

What is claimed is:

1. A laminated padlock, comprising a laminated padlock body formed by laminating a plurality of lock sheets (1) and riveting with rivets (3), a lock core assembly arranged in the laminated padlock body, and a lock beam (2) connected with the top of the laminated padlock body, wherein one end of the lock beam (2) connected with the laminated padlock body is provided with a lock beam spring (22); and the lock beam (2) expands and contracts up and down to open and close the laminated padlock, characterized in that the middle of the lock sheet (1) is provided with an adaptive installation port; when a plurality of lock sheets (1) are laminated together, the installation port forms an accommodating cavity in the laminated padlock body; the lock core assembly is installed in the accommodating cavity, and a plurality of rivet holes (11) are also arranged on the lock sheets (1); the rivets (3) are matched with the rivet holes (11) to rivet and fix the plurality of lock sheets (1) into a whole; the lock core assembly comprises a first lock tongue (5) and a second lock tongue (6) which are mutually matched, a large frame (7), a small frame (8), a lock core shaft (9) and cipher wheels (96); the first lock tongue (5) and the second lock tongue (6) are connected through a lock tongue pin (51); the lock tongue pin (51) is provided with a lock tongue spring (52) for returning the first lock tongue (5) and the second lock tongue (6); the large frame (7) and the small frame (8) are docked below the first lock tongue (5) and the second lock tongue (6); the middle of the large frame (7) is provided with a first opening (71); a positioning resilient piece (72) is inserted into the first opening (71); both sides of the large frame (7) are symmetrically provided with shaft holes (73); the lock core shaft (9) is installed on the large frame (7) through the shaft holes (73); the middle of the small frame (8) is provided with a second opening (84); a small resilient piece (85) is inserted into the second opening (84), and the lower part of the small frame (8) is provided with a bending part (82) and a plurality of branch plates (83); the lock core shaft (9) is sleeved with a plurality of short lock cores (91) and long lock cores (92); one end of the short lock cores (91) and the long lock cores (92) is respectively provided with a circular arc part (921); the circular arc parts (921) are provided with rectangular notches (912); the other end of the short lock cores (91) and the long lock cores (92) is respectively provided with bulges (911); one end of the lock core shaft (9) which extends from the large frame (7) is provided with a nut (94); a lock core spring (95) is installed between the nut (94) and the side edge of the large frame (7); the lock core shaft (9) on the inner side of the lock core spring (95) is provided with a copper sheath (93); and the lock core shaft (9) on the inner side of the large frame (7) is provided with a plurality of cipher wheels (96).

2. The laminated padlock according to claim 1, characterized in that the lower part of the large frame (7) is provided with a plurality of bar-shaped limiting plates (74); the bar-shaped limiting plates (74) are distributed among the cipher wheels (96); and the ends of the bar-shaped limiting plates (74) are provided with L-shaped limiting chucks (741) adapted with the rectangular notches (912).

3. The laminated padlock according to claim 1, characterized in that the upper part of the small frame (8) is provided with an end part (81) bent towards the large frame (7); the end part (81) can rotate back and forth between the first lock tongue (5) and the second lock tongue (6), thereby controlling the opening and closing of the laminated padlock; the bending part (82) is clamped to the outer side of the lock core shaft (9); and the branch plates (83) are distributed among the cipher wheels (96).

4. The laminated padlock according to claim 1, characterized in that the first lock tongue (5) and the second lock tongue (6) are rectangles with a V-shaped head (61) at one end, and the V-shaped heads (61) are arranged opposite to each other; and both sides of the lock beam (2) corresponding to the V-shaped heads (61) of the first lock tongue (5) and the second lock tongue (6) are provided with adaptive positioning grooves (21).

5. The laminated padlock according to claim 1, characterized in that one end of the lock beam (2) provided with the lock beam spring (22) is provided with a lock beam card (23) and a lock beam card gasket (24).

6. The laminated padlock according to claim 1, characterized in that one end of the small resilient piece (85) is bent and abutted against the small frame (8), and the other end is abutted against the inner side wall of the laminated padlock body; a clamping part (721) is arranged above the positioning resilient piece (72), and a plurality of dialing plates (722) are arranged below the positioning resilient piece; and the dialing plates (722) are abutted against the grooves of the cipher wheels (96).

7. The laminated padlock according to claim 1, characterized in that engaging parts (961) are arranged in the centers of the cipher wheels (96); and the engaging parts (961) are matched and connected with the bulges (911) on the short lock cores (91) and the long lock cores (92).

8. The laminated padlock according to claim 1, characterized in that the upper and lower lock sheets (1) in the plurality of lock sheets (1) near the first lock tongue (5) and the second lock tongue (6) are provided with lock holes (12); the lock holes (12) can be used for locking the lock beam (2) to the laminated padlock body; when the cipher is adjusted, a cipher adjusting rod (4) needs to be used together; and one end of the cipher adjusting rod (4) inserted into the lock holes (12) is provided with an inserting joint (41).

9. The laminated padlock according to claim 1, characterized in that a flat end surface (9211) is cut on the circular arc part (921); and when the flat end surface (9211) rotates tangent to the branch plate (83), the branch plate (83) rotates inwards to drive the end part (81) of the small frame (8) away from the lock tongue pin (51).

10. The laminated padlock according to claim 1, characterized in that when the cipher wheel (96) is adjusted to a state of right cipher, the flat end surface (9211) is tangent to the branch plate (83); the limiting chucks (741) are docked with the notches (912); after the cipher adjusting rod (4) is inserted from the lock holes (12) and rotated, the lock core shaft (9) is pushed to move to the other side, so that the bulges (911) of the short lock cores (91) and the long lock cores (92) are separated from the engaging parts (961) on the cipher wheels; and at this moment, new ciphers can be changed.

* * * * *